US011592031B2

(12) United States Patent
Ko

(10) Patent No.: US 11,592,031 B2
(45) Date of Patent: Feb. 28, 2023

(54) BLOWER HOUSING ASSEMBLY STRUCTURE

(71) Applicant: Yu Jen Ko, Taichung (TW)

(72) Inventor: Yu Jen Ko, Taichung (TW)

( * ) Notice: Subject to any disclaimer, the term of this patent is extended or adjusted under 35 U.S.C. 154(b) by 0 days.

(21) Appl. No.: 17/406,009

(22) Filed: Aug. 18, 2021

(65) Prior Publication Data

US 2022/0082109 A1 Mar. 17, 2022

(30) Foreign Application Priority Data

Sep. 14, 2020 (TW) ..... 109131522

(51) Int. Cl.
*F04D 29/42* (2006.01)
*F04D 17/08* (2006.01)

(52) U.S. Cl.
CPC ..... *F04D 29/4206* (2013.01); *F04D 17/08* (2013.01)

(58) Field of Classification Search
CPC ..... F04D 17/08; F04D 17/125; F04D 17/162; F04D 25/166; F04D 29/4206; F04D 29/4226; F04D 29/424; F04D 29/4246
See application file for complete search history.

(56) References Cited

U.S. PATENT DOCUMENTS 3,469,772 A * 9/1969 McDonald ..... F04D 29/668 417/350
5,257,904 A * 11/1993 Sullivan ..... F04D 29/4233 415/206
9,574,568 B2 * 2/2017 Dickinson ..... F04D 25/166
11,041,508 B2 * 6/2021 Chen ..... F04D 17/16
2022/0090608 A1 * 3/2022 Ko ..... F04D 29/281

* cited by examiner

*Primary Examiner* — J. Todd Newton
(74) *Attorney, Agent, or Firm* — Guice Patents PLLC

(57) ABSTRACT

A blower housing assembly structure includes a locking base formed by aluminum die casting and two opposite casing covers disposed on both sides of the locking base respectively. The locking base has two opposite side connecting plates, each having a connection part formed at the top of the side connecting plate, and a side of each casing cover has an intake vent, and the two casing covers have two opposite half-extended pipe sections extending from the edges of the locking base connection part respectively, so that the half-extended pipe sections of the two casing covers are engaged to form an exhaust vent of a housing. This invention has the advantages of simple structure, easy assembling, effective alignment and high stability and the effects of preventing damages by vibration and reducing the noise during operation.

7 Claims, 5 Drawing Sheets

BLOWER HOUSING ASSEMBLY STRUCTURE

BACKGROUND OF INVENTION

Field of Invention

The present invention relates to the technical field of blowers, in particular to a blower housing assembly structure capable of improving the production and assembling efficiency of the housing of the blowers, improving the mechanical stability of the blower to reduce damages by vibrations, and extend the service life of the blowers effectively.

Description of the Related Art

Blowers are widely used in various places where the exchange of air and the discharge of exhaust gas are needed, such as kitchens, or places above a cooking stove, so that exhaust gas can be discharged to the outside quickly. With reference to FIG. 1 for a conventional blower housing structure, the conventional blower housing structure generally includes a housing (10) and a fan assembly (20), and the housing (10) is formed by a substantially b-shaped annular shell (11) having an eccentric exhaust vent (110), a pair of side covers (12) with corresponding contour shape respectively and pivotally coupled to both side of the annular shell (11), an intake vent (13) configured to each respective side cover (12), a partition (15) disposed in the annular shell (11) of the housing (10), a plurality of lugs (150) formed at the edge of the partition (15) edge and configured to be corresponsive to an inner wall of the annular shell (11), and a plurality of locking parts (155) provided for locking the lugs (15) of the partition (15) from the outer side of the annular shell (11), so that the partition (15) can be fixed into the annular shell (11), and the partition (15) is provided for locking a dual-axis motor (21) of the fan assembly (20), and each the output shafts (210) on both sides of the dual-axis motor (21) has a corresponding fan (25), so that when the dual-axis motor (21) drives the fans (25) on both side to perform a high speed rotation, air is entered from the intake vents (13) of two side covers (12) and discharged from an exhaust vent (110) of the annular shell (11) by the centrifugal effect.

During the process of assembling the blower, the annular shell (11), the side covers (12) and the partition (15) of the housing (10) formed by a stamping technology, metal sheet are affected by the elastic strain, so that it is uneasy to align with the screw or pivot hole, and it is necessary to install the partition (15) into the annular shell (11) first, and then lock the dual-axis motor (21) to the partition (15) after the partition (15) is pivoted and fixed, and then install each fan (25), and finally install each of the side covers (12) to complete the whole assembling operation. For maintenance and repair, it is necessary to removal the parts and carry out the procedure reversely. Obviously, the operation is cumbersome and inconvenient.

In addition, the conventional blower housing (10) is formed by pivoting or locking a plurality of metal sheets, and thus the structural strength of the assembly is obviously insufficient, and the manufacture by connecting more metal sheets will be increased. Since related connectors (such as pivots) are required for the assembly, therefore additional manufacturing cost will be incurred.

Since the conventional blower housing (10) is generally formed by the annular shell (11), the side covers (12) and the partition (15) made metal sheets, and there is a poor connection issue of the metal sheets. As a result, the metal sheets may be vibrated easily during the operation of the blower, which will loosen or damage the housing (10) and shorten the service life of the blower. When the vibration frequency of each metal sheet and the wind pressure frequency generated by the operation of the blower produce a resonance, the overall noise generated by the blower will be increased significantly.

In other words, the conventional blower housing structure and assembly have the aforementioned drawbacks including the difficult assembling, insufficient strength and easy vibration that cause the disadvantages of cumbersome installation and removal, high assembling cost, easy damage, increased noise, etc. Finding a feasible solution for these problems is a topic for the related manufacturers and users to explore and also the main objective of the present invention.

In view of the aforementioned drawbacks of the prior art, the inventor of the present invention based on years of experience in the related industry to conduct extensive research and experiment, and finally developed a blower housing assembly structure to overcome the drawbacks of the prior art.

SUMMARY OF THE INVENTION

Therefore, it is a primary objective of the present invention to overcome the drawbacks of the prior art, by providing a blower housing assembly structure to make the housing assembly more stably, so as to achieve the effects of reducing the resonance during the operation of the blower, minimizing the noise and damage caused by the vibration, and extending the service life of the blower.

Another objective of the present invention is to provide a blower housing assembly structure with a simplified structure capable of making the installation and remover simpler, increasing the structural strength and lower the manufacturing cost of the blower housing.

To achieve the aforementioned and other objectives, the present invention adopts the following technical measures to implement the above objective and performance, and the blower housing assembly structure of the invention comprises: a locking base, formed by aluminum die casting, and the locking base having two opposite side connecting plates with a connection part formed at the top of the two side connecting plates, and the two side connecting plates of the locking base having a mounting hole each, and the two mounting holes being configured to be opposite to one another and disposed on both sides of the locking base to form two opposite casing covers respectively, and each of the casing covers being formed by aluminum die casting and having an intake vent formed on a side of each of the casing covers, and the two casing covers having opposite half-extended pipe sections extending from the corresponding edge of the locking base connection part, so that the half-extended pipe sections of the two casing covers can be engaged with each other to form an exhaust vent of a housing.

In addition, each of the two side connecting plates on the locking base has a mounting hole, and the two mounting holes are configured to be opposite to each other.

The two opposite casing covers are disposed on both sides of the locking base, and each casing cover is formed by aluminum alloy die casting, and an intake vent is formed on a side of each casing cover, and a half-extended pipe section is extended from an edge of each of the two casing covers and configured to be corresponsive to the locking base connection part, so that the half-extended pipe section of the two casing covers can be engaged to form an exhaust vent of a housing.

With the aforementioned technical means, the blower housing assembly structure of the present invention can be made of a housing which is manufactured by aluminum alloy die casting and formed by engaging the locking base and the casing cover, and the invention has the advantages of simple structure, effective alignment for locking, and enhanced stability and the effect of preventing damages caused by vibration, and providing a good cooling effect to effectively extend the service life of the structure, reduce the noise during operation, provide an easy assembling procedure, lower manufacturing and maintenance costs, improve the practicality, and increase the added value and economic benefit.

To achieve the objectives and effects of the present invention, the invention discloses the following technical measures.

The two side connecting plates of the housing have a plurality of first lock holes formed at the periphery of the mounting hole, so that each side connecting plate of the locking base can be locked to a motor of a fan assembly by each respective first lock hole, and the motor can be communicated with the outside through a gap of the two side connecting plates to achieve a cooling effect.

The two side connecting plates of the locking base have a plurality of second lock holes formed at an adjacent edge thereof, and each casing cover has a plurality of third lock holes formed at an adjacent edge thereof and configured to be corresponsive to the second lock holes respectively for locking the two side casing covers onto the two side connecting plates of the locking base by a locking part.

Each of the two opposite side connecting plates of the locking base of the housing has an oil drain hole formed near the bottom edge.

The two casing covers have horizontal edges formed at the tops of the two half-extended pipe sections respectively and coupled to each other to define a same plane.

The present invention will become clearer in light of the following detailed description of an illustrative embodiment of this invention described in connection with the drawings.

DESCRIPTION OF THE PREFERRED EMBODIMENTS

Figure 1:
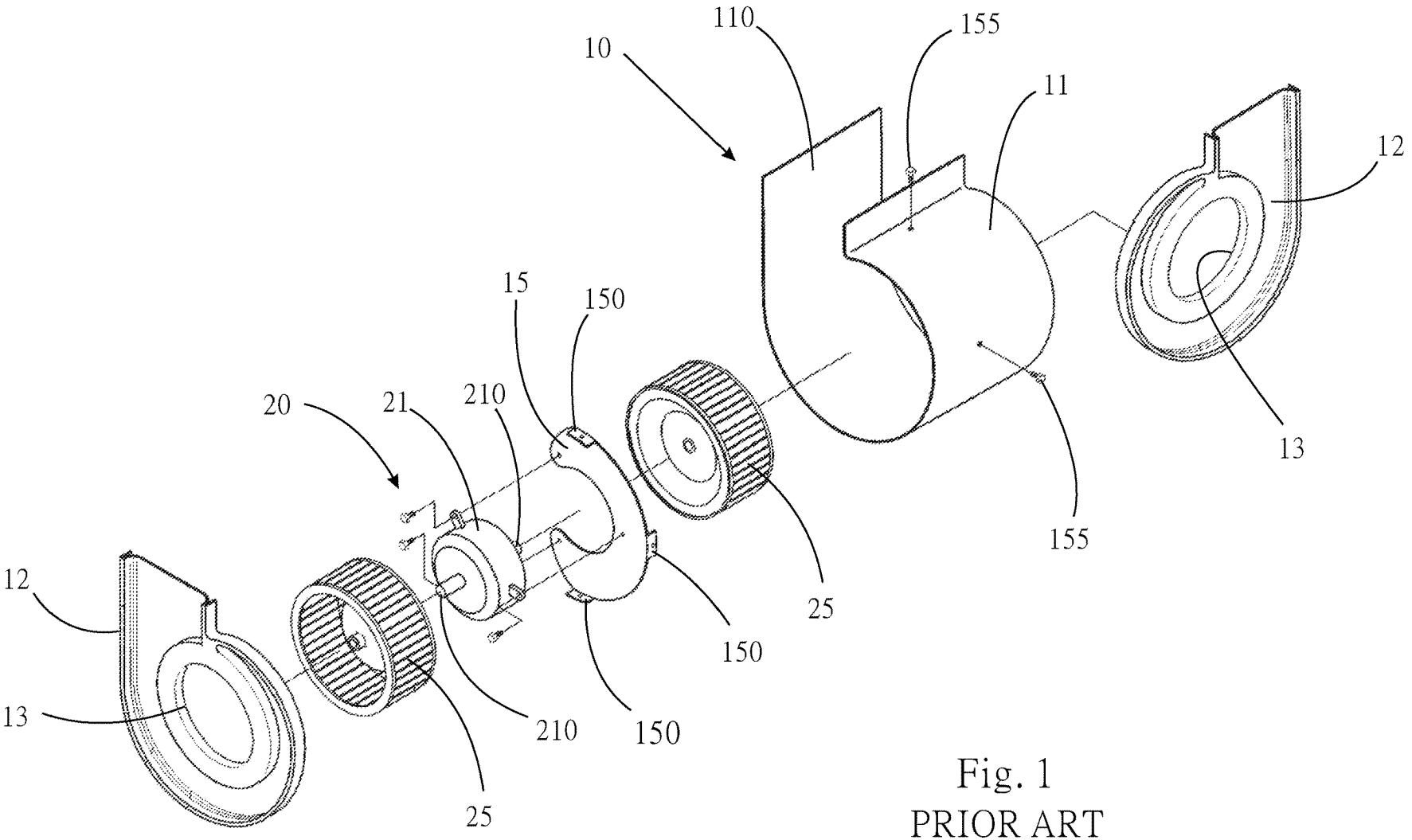
Fig. 1 PRIOR ART
FIG. 1 is an exploded view of a conventional blower housing.

The present invention discloses the specific embodiments and components of a blower housing assembly structure of the present invention as shown in the figures, all of the terms including front and rear, left and right, top and bottom, up and down, and horizontal and vertical are used for the convenience of description only, but not intended for limiting the scope of the present invention, nor restricting the components to any position or spatial direction. The dimensions specified in the drawings and the description can be changed according to the design and requirements of the specific embodiments of the present invention without departing from the scope of the present invention.

Figure 2:
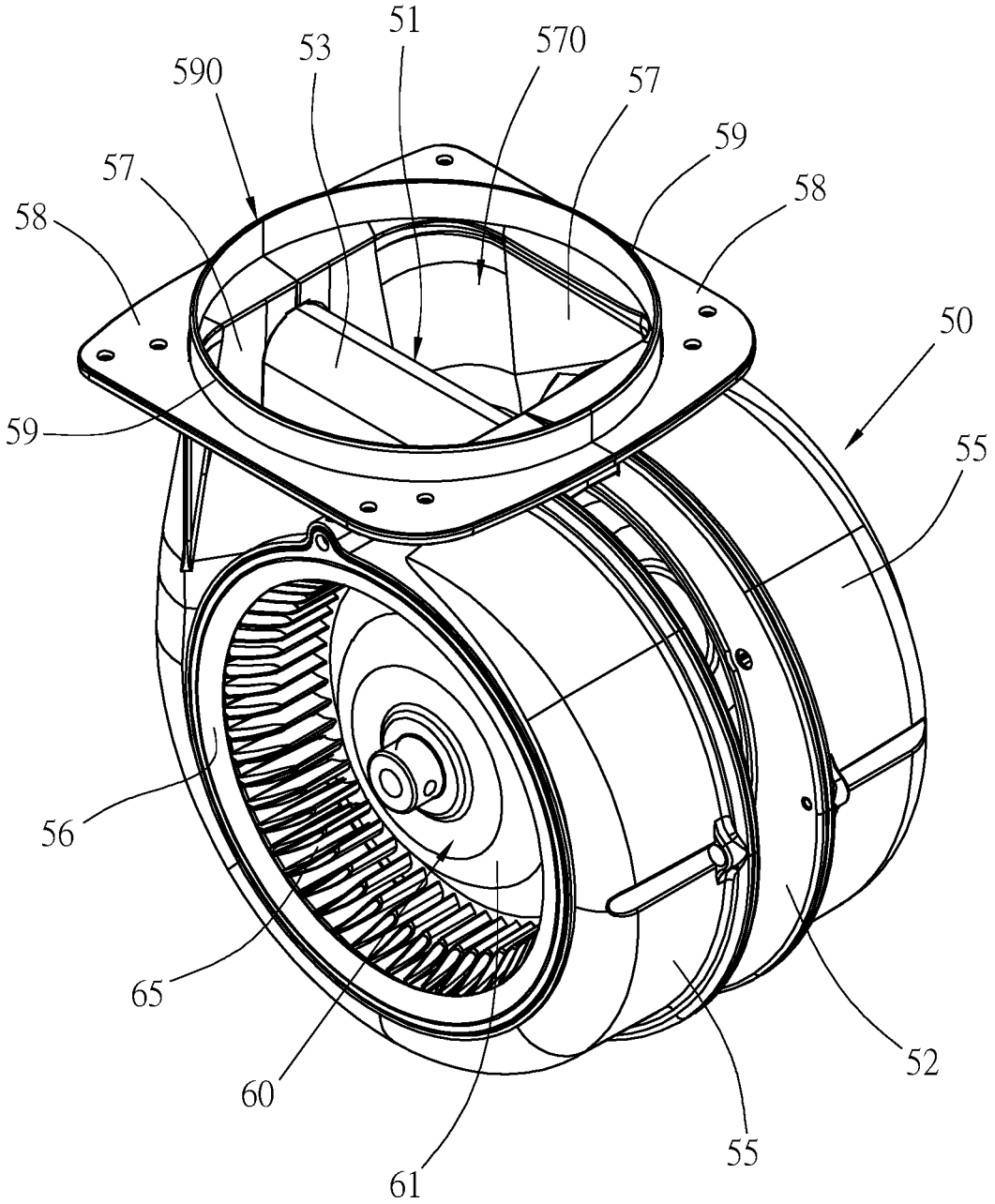
FIG. 2 is a perspective view of a blower housing assembly structure of the present invention.

With reference to FIG. 2 for a blower housing assembly structure of the present invention, the blower is formed by a housing (50) and a fan assembly (60) installed in the housing (50), wherein the fan assembly (60) has a motor (61) mounted onto the housing (50) and the motor (61) is provided for driving a plurality of vanes on both side to rotate in a high speed in order to blow an air flow, which is a part of the conventional blower structure and thus will not be repeated.

With reference to FIGS. 2 to 5 for the technical characteristics of the blower housing assembly structure of the present invention, the housing (50) is manufactured by aluminum die casting and formed by a locking base (51) and two opposite casing covers (55) mounted onto both sides of the locking base (51), wherein the locking base (51) has two opposite side connecting plates (52), and a connection part (53) formed on the top of each of two side connecting plates (52), so that the locking base (51) has a substantially U-shaped cross-section, and each of the two side connecting plates (52) of the locking base (51) has a mounting hole (54), and the two mounting holes (54) are configured to be opposite to each other, and each mounting hole (54) has a plurality of first lock holes (521) formed at the periphery of mounting hole (54), so that each side connecting plate (52) of the locking base (51) can lock a motor (61) of a fan assembly (60) onto the mounting hole (54) by each respective first lock hole (521), and the motor (61) can be communicated to the outside through a gap of the two side connecting plates (52) of the locking base (51), so as to provide a cooling effect to reduce the damage to the fan assembly (60) of the motor (61) by overheat. In addition, the two side connecting plates (52) of the locking base (51) have a plurality of second lock holes (522) formed at adjacent edges and provided for locking the casing covers (55) respectively, and each of the two opposite side connecting plates (52) of the locking base (51) has an oil drain hole (525) formed near the bottom edge and provided for discharging a waste oil in the housing (50) and received by an oil collection cup (not shown in the figure).

Each of the two side casing cover (55) has an intake vent (56) formed at the position corresponding to a vane of the fan assembly (60), and each casing cover (55) further has a plurality of third lock hole (550) formed at adjacent edges and configured to be corresponsive to the second lock holes (522) of the side connecting plate (52) respectively, and provided for locking the two side casing cover (55) onto the two side connecting plates (52) of the locking base (51) by a locking part (such as a screw, not shown in the figures), and each of the two side casing covers (55) has a half-extended pipe section (57) extended from an edge of the corresponding connection part (53) of the locking base (51), so that the half-extended pipe sections (57) of the casing covers (55) can be engaged to form an exhaust vent (570) of the housing (50), and each casing cover (55) has a horizontal edge (58) formed at the top of each half-extended pipe section (57), and the horizontal edges (58) can be coupled to define a same plane, and each of the two casing covers (55) above the horizontal edges (58) has a half-extended pipe section (59) protruded from the casing cover (55), and the two half-extended pipe sections (59) can be engaged to form a ring-shaped connection pipe (590) for connecting an external exhaust pipe (not shown in the figure).

The aforementioned components constitute a blower housing assembly structure with the features of simple structure and high stability.

Figure 3:
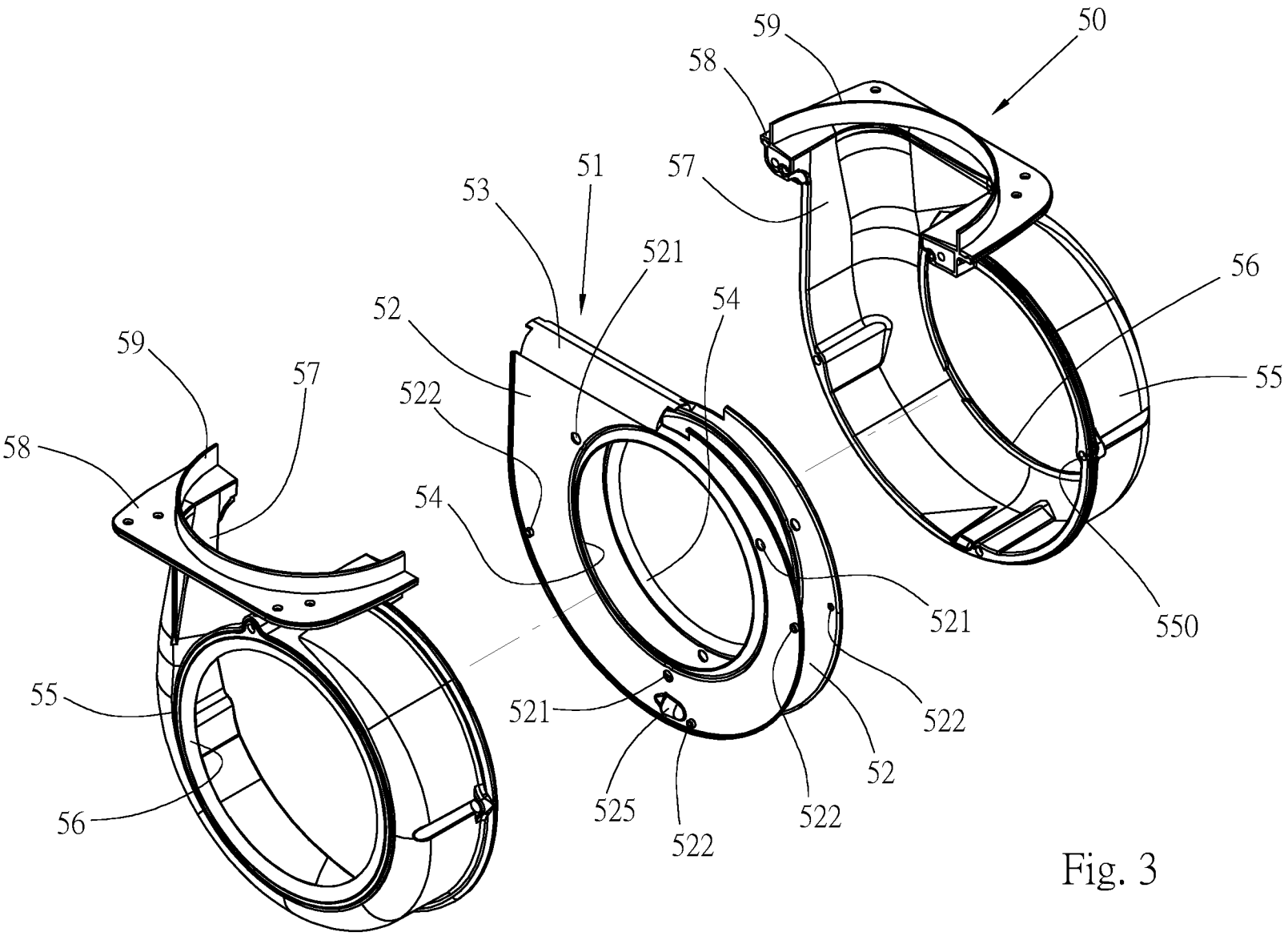
FIG. 3 is an exploded view of a blower housing assembly structure of the present invention, showing the type and relative relationship of the components of the structure.
Figure 4:
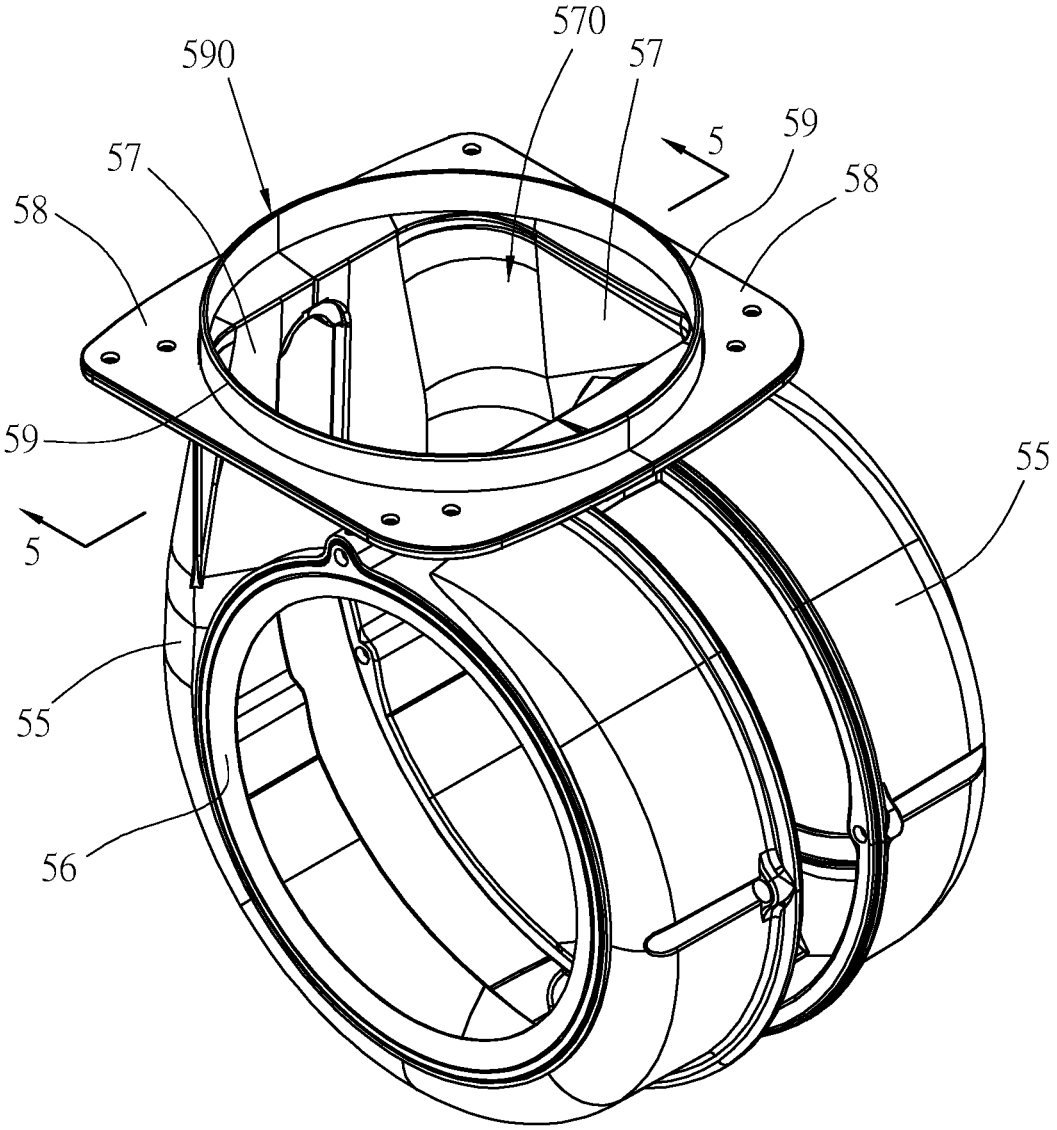
FIG. 4 is a perspective view of a housing in the blower housing assembly structure of the present invention.
Figure 5:
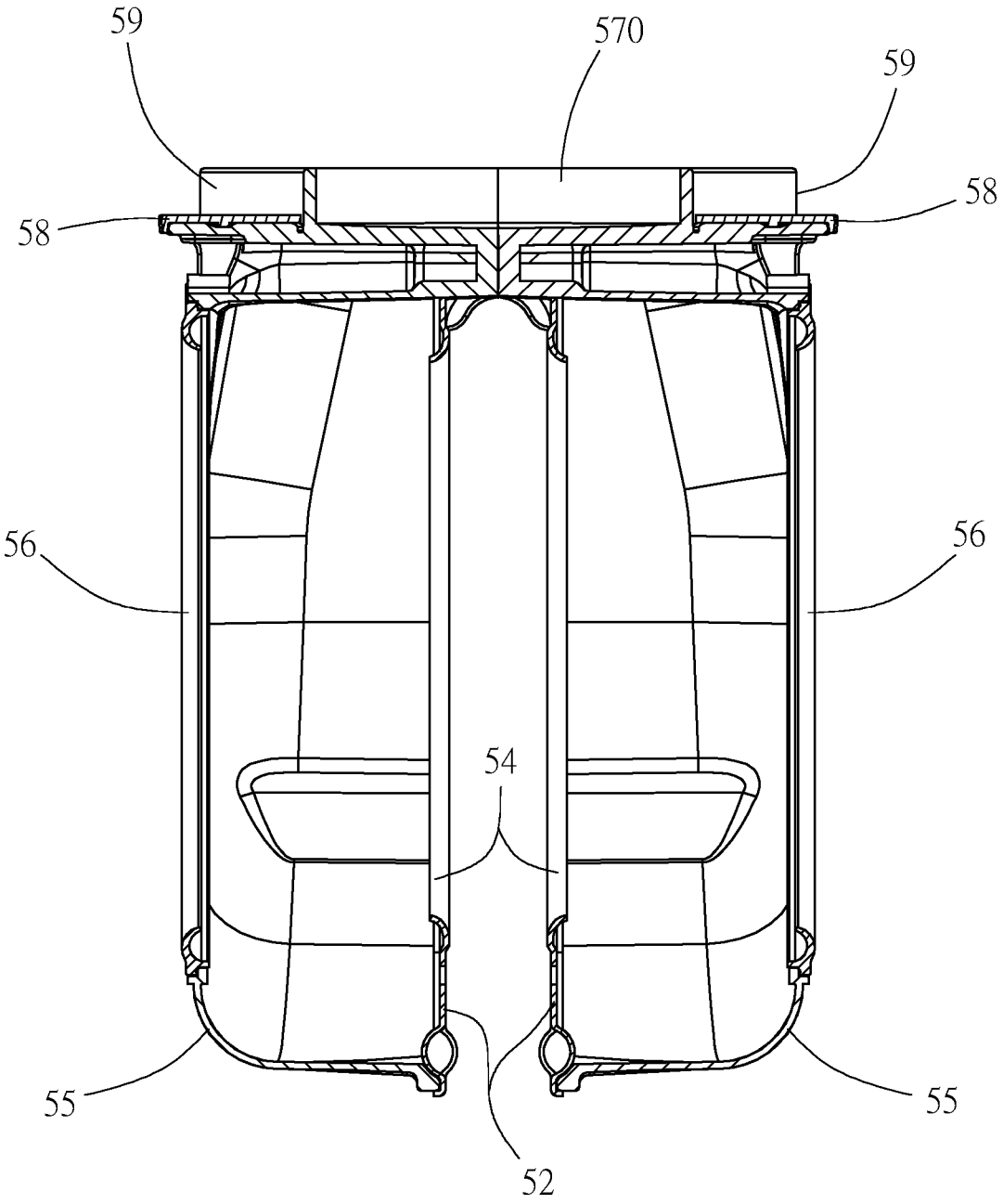
FIG. 5 is a cross-sectional view of Section 5-5 of the blower housing assembly structure of the present invention as depicted in FIG. 4.

In a practical application of the blower housing assembly structure of the present invention as shown in FIGS. 2 and 3, the motor (61) is mounted onto two sides connecting plates (52) of the locking base (51) respectively. Since there is a gap maintained between the two side connecting plates (52), the motor (61) of the fan assembly (60) can be communicated with the outside to provide a cooling effect, so as to reduce the damage to the motor (61) caused by overheat.

In addition, the housing (50) is formed by engaging the locking base (51) made by aluminum alloy die casting with the casing cover (55) to achieve the effects of simple structure, excellent strength, and easy alignment between the second and third lock holes (522, 550) for screw connection to lock the motor (60) of the fan assembly (60) motor (61). Overall speaking, the installation and removal procedure is simple and easy for installation, maintenance and repair, so that the manufacturing procedure can be simplified and the manufacturing cost can be reduced.

In the meantime, the housing (50) is comprised of the locking base (51) and two side casing covers (55) which are manufactured by aluminum alloy die casting, so that the locking base (51) and the casing covers (55) can be coupled easily, and the motor (61) of the fan assembly (60) can be locked effectively. As a result, when the motor (61) of the blower is rotated at a high speed, the resonance produced by the vibration frequency and the wind pressure frequency generated during the operation of the blower can be avoided effectively to reduce the overall noise, and to prevent the housing (50) from being loosened or damaged.

In summation of the description of the aforementioned structural design and operation, the blower housing assembly structure of the present invention is comprised of the housing (50) formed by engaging the locking base (51) (which is manufactured by aluminum alloy die casting) with the casing cover (55) and has the features of simple structure, effective alignment for connection, and high stability, and easy assembling, and achieves the effects of preventing damages caused by vibration, providing the cooling effect to effectively extend the service life, reducing the noise generated during operation, lowering the manufacturing and maintenance costs, and improving the practicality of the product.

In summation of the description above, the present invention overcomes the drawbacks of the prior art, improves the performance significantly, and complies with the requirements of patent application, and is thus duly filed for patent application. While the invention has been described by means of specific embodiments, numerous modifications and variations could be made thereto by those skilled in the art without departing from the scope and spirit of the invention set forth in the claims.

What is claimed is:

1. A blower housing assembly structure, comprising: a locking base, formed by aluminum die casting, and the locking base having two side connecting plates located on opposite sides thereof and having a connection part formed at a top of the two side connecting plates, and the two side connecting plates of the locking base having a mounting hole each being two mounting holes, and the two mounting holes being configured to be opposite to one another and disposed on both sides of the locking base, and two casing covers respectively mounted onto both opposite sides of the locking base, and each of the two casing covers being formed by aluminum die casting and having an intake vent formed on a side of each of the two casing covers, and the two casing covers having half-extended pipe sections extending from an opposite corresponding edge of the connection part of the locking base, so that the half-extended pipe sections of the two casing covers can be engaged to form an exhaust vent of a housing;

wherein the connection part is formed on the top of each of two side connecting plates, so that the locking base has a substantially U-shaped cross-section, the two side connecting plates of the housing have a plurality of first lock holes formed at the periphery of the mounting hole, so that each side connecting plate of the two connecting plates of the locking base can be locked to a motor of a fan assembly by each respective first lock hole of the plurality of lock holes, and the motor can be in communication with the outside through a gap between the two side connecting plates to achieve a cooling effect.

2. The blower housing assembly structure according to claim 1, wherein the two side connecting plates of the locking base have a plurality of second lock holes formed at an adjacent edge thereof, and each casing cover has a plurality of third lock holes formed at an adjacent edge thereof and configured to correspond to the second lock holes respectively for locking the two side casing covers onto the two side connecting plates of the locking base by a locking part.

3. The blower housing assembly structure according to claim 1, wherein each of the two opposite side connecting plates of the locking base of the housing has an oil drain hole formed near a bottom edge.

4. The blower housing assembly structure according to claim 2, wherein each of the two opposite side connecting plates of the locking base of the housing has an oil drain hole formed near a bottom edge.

5. The blower housing assembly structure according to claim 1, wherein the two casing covers have horizontal edges formed at a top of each of the two half-extended pipe sections respectively and coupled to each other to define a same plane.

6. The blower housing assembly structure according to claim 1, wherein the two casing covers have half-connected pipe sections protruding from a top of each of the two half-extended pipes and coupled to each other to form a ring-shaped connection pipe for coupling an external exhaust pipe.

7. The blower housing assembly structure according to claim 5, wherein the two casing covers have half-connected pipe sections protruding from the tops of the two half-extended pipes and coupled to each other to form a ring-shaped connection pipe for coupling an external exhaust pipe.

* * * * *